US007013891B2

(12) United States Patent
Richardson et al.

(10) Patent No.: US 7,013,891 B2
(45) Date of Patent: Mar. 21, 2006

(54) RESPIRATORS

(75) Inventors: Grant Stuart Richardson, Salisbury (GB); William George Mathers, Salisbury (GB)

(73) Assignee: The Secretary of State for Defense in Her Britannic Majesty's Government of the United Kingdom of Great Britain and Northern Ireland, (GB)

( * ) Notice: Subject to any disclaimer, the term of this patent is extended or adjusted under 35 U.S.C. 154(b) by 0 days.

(21) Appl. No.: 10/344,119

(22) PCT Filed: Aug. 6, 2001

(86) PCT No.: PCT/GB01/03518

§ 371 (c)(1),
(2), (4) Date: Feb. 7, 2003

(87) PCT Pub. No.: WO02/11816

PCT Pub. Date: Feb. 14, 2002

(65) Prior Publication Data

US 2003/0168060 A1 Sep. 11, 2003

(51) Int. Cl.
*A62B 18/08* (2006.01)

(52) U.S. Cl. ..... 128/201.15; 128/206.12; 128/206.22; 128/206.23; 128/206.24

(58) Field of Classification Search ..... 128/200.24, 128/201.15, 201.23, 201.24, 201.25, 201.29, 128/203.29, 204.18, 205.12, 205.24, 205.25, 128/205.27–207.18
See application file for complete search history.

(56) References Cited

U.S. PATENT DOCUMENTS

| | | | | | |
|---|---|---|---|---|---|
| 2,381,568 | A | * | 8/1945 | Booharin | 128/201.15 |
| 2,810,386 | A | | 10/1957 | Reed | |
| 3,602,219 | A | * | 8/1971 | Warncke | 128/201.15 |
| 3,680,555 | A | * | 8/1972 | Warncke | 128/206.24 |
| 4,430,995 | A | * | 2/1984 | Hilton | 128/204.21 |
| 4,534,344 | A | * | 8/1985 | Constance-Hughes | 128/201.15 |
| 4,574,799 | A | | 3/1986 | Warncke | |
| 4,886,056 | A | * | 12/1989 | Simpson | 128/201.15 |
| 4,905,683 | A | * | 3/1990 | Cronjaeger | 128/202.22 |
| 4,926,855 | A | * | 5/1990 | Hellquist et al. | 128/201.28 |
| 4,971,052 | A | * | 11/1990 | Edwards | 128/205.12 |
| 5,303,701 | A | | 4/1994 | Heins et al. | |
| 5,372,130 | A | * | 12/1994 | Stern et al. | 128/205.25 |
| 5,592,935 | A | * | 1/1997 | Elstran et al. | 128/205.29 |
| 5,720,281 | A | * | 2/1998 | Allen et al. | 128/206.23 |
| 2002/0092522 | A1 | * | 7/2002 | Fabin | 128/201.23 |

FOREIGN PATENT DOCUMENTS

EP 0130707 1/1985

(Continued)

*Primary Examiner*—Glenn K. Dawson
(74) *Attorney, Agent, or Firm*—Dean W. Russell; Kristin M. Crall; Kilpatrick Stockton LLP

(57) ABSTRACT

A respirator (1) comprises an inner, oronasal, mask (2) enclosed within an outer, face sealing, mask (3) so as to define a cavity (4) therewith, a screw-threaded air inlet (5) for conducting inhaling air to the interior of the inner mask (2), a filter canister (7) for filtering the inhaling air, and an air outlet (8) for conducting exhaled air from the interior (6) of the inner mask (2). In normal operation, air is inhaled and exhaled solely through the inner mask (2) and so substantially no air pressure differential exists between the ambient atmosphere (9) and the cavity (4) which will allow ambient air to enter the cavity.

13 Claims, 5 Drawing Sheets

FOREIGN PATENT DOCUMENTS

| | | | |
|---|---|---|---|
| EP | 0334555 | 9/1989 | |
| EP | 0352938 | 1/1990 | |
| FR | 2705899 | * 12/1994 | ..... 128/204.18 |
| GB | 1379429 | 1/1975 | |
| GB | 1587812 | 4/1981 | |
| GB | 2203050 | * 12/1988 | ..... 128/206.12 |
| GB | 2209123 | 5/1989 | |
| GB | 2211098 | 6/1989 | |
| GB | 2264647 | 9/1993 | |
| GB | 2301039 | 11/1996 | |

* cited by examiner

RESPIRATORS

This application claims priority to Great Britain Application No. 0019291.4 filed on Aug. 7, 2000 and International Application No. PCT/GB01/0351 8 filed on Aug. 6, 2001 and published in English as International Publication No. WO 02/11816 A1 on Feb. 14, 2002, the entire contents of which are hereby incorporated by reference.

FIELD OF THE INVENTION

This invention relates to respirators and provides a respirator wherein the risk of face seal inleakage is substantially reduced.

BACKGROUND OF THE INVENTION

Respirators are used in any environment in which inhalation of the ambient atmosphere is likely to cause harm, for example an atmosphere comprising dangerous chemicals. At their most basic, respirators comprise a mask which is sealed against the face and an air inlet to permit air into the mask so that the user may breathe, with a filter often being used to remove unwanted materials from the inhaled air. There are primarily two types of respirator in use, these being positive pressure respirators and negative pressure respirators. In all respirators it is desirable to prevent the potentially contaminated ambient atmosphere from entering the cavity between the face and the mask. Such ingress may occur if the cavity is at a negative pressure relative to the ambient atmosphere and the mask face-seal fails. Positive pressure respirators try to overcome this problem by providing a steady flow of pressurised air to the user. Battery operated pumps are conventionally used to draw air through the filter to the user. Such respirators are expensive, power-hungry, bulky and susceptible to failure; even though the air is supplied under pressure, the mask cavity may experience a negative pressure relative to the ambient atmosphere under certain circumstances, for instance, when the user speaks or undertakes exercise. Negative pressure regulators such as the respirator worn by British Army personnel, are, in comparison to positive pressure respirators, cheap, lightweight and surprisingly effective. Negative pressure respirators work by the breathing of the user creating a negative pressure in the mask which causes ingress of air from the ambient atmosphere through the filter and into the mask cavity. There is thus no need for bulky air pumps. However, the mask is at a negative pressure relative to the ambient atmosphere for a substantial part of the breathing cycle. Furthermore, misting of the eyepieces that are common in such a mask is a significant problem; such misting arises from exhaled air and from the user sweating into the mask cavity. Misting of the eyepieces may severely compromise the performance of the wearer. Inhaled air may be diverted over the eye pieces into the mouth to reduce the misting problem. However, such an approach has not been entirely successful. The present invention tries to alleviate some of the problems of the prior art.

SUMMARY OF THE INVENTION

According to the present invention, a respirator comprises an inner, oronasal, mask enclosed within an outer, face-sealing, mask so as to define a cavity therewith, a respirator air inlet for conducting inhaling air to the interior of the inner mask, filter means for filtering said inhaling air, and a respirator air outlet for conducting exhaled air from the interior of the inner mask, whereby, in normal operating mode, air is inhaled and exhaled solely through the inner, oronasal mask and so substantially no air pressure differential exists between the ambient atmosphere and said cavity which will allow ambient air to enter said cavity.

"Solely" is used to indicate that air is neither inhaled nor exhaled through the cavity formed between the oronasal mask and the outer mask under normal operating conditions. Air may be inhaled and exhaled through the cavity in certain embodiments of the present invention, but only in a back-up mode, should certain elements of the respirator fail. Furthermore, air may be inhaled through other components of the respirator as discussed below.

The respirator is preferably provided with means for supplying pressurised air to said cavity between the inner and outer masks. This creates a positive pressure within the cavity relative to the ambient air outside of the respirator, the pressure difference reducing ingress of potentially contaminated ambient air into the respirator should failure of the outer mask seal occur. The air pressure supply means preferably draws filtered air from said filter means. The air pressure supply means may be an air pump which may be driven by an electric motor powered by battery means.

It is also preferred that the respirator further comprises at least one eye piece wherein either of the air supplied by the air pressure supply means or inhaling air is used to demist the at least one eye piece.

In one embodiment, the outer mask is provided with the at least one eye piece and part of the air supplied by the air pressure supply means is used to demist the at least one eye-piece. The air pressure supply means thus demists the eye piece(s) and provides a positive pressure in the cavity. It is, of course, preferred that the air supplied by the air pressure supply means is filtered.

In an alternative embodiment, the outer mask is provided with the at least one eye piece and the respirator further comprises air guidance means that is switchable between a first operating position in which, in use, part of the air supplied by the air pressure supply means is used to demist the at least one eye piece and a second operating position in which, in use, inhaling air is used to demist the at least one eye piece. This allows air from the air pressure supply means to be directed to the eye pieces during normal operation. In the event of failure of the air pressure supply means, the air guidance means may be switched to the second operating position to divert inhaling air to the eye pieces, thus avoiding demisting.

Alternatively, the at least one eye piece forms part of an ocular mask, the ocular mask being enclosed within the outer, face-sealing mask, wherein the ocular mask is provided with an ocular mask air inlet for conducting inhaling air to the interior of the ocular mask and an ocular mask air outlet for conducting inhaling air to the interior of the oronasal mask such that, in use, air is inhaled through the ocular mask before entering the oronasal mask. This provides a respirator wherein demist still occurs even when the seal of the outer mask fails. If the air pressure supply means fails, then the eyepiece(s) are still demisted. There is no need to reroute inhaled air over the eyepiece(s). Furthermore, enclosure of the eyes prevents harm occurring to the wearer's vision should noxious materials enter the cavity between the oronasal/ocular masks and the outer mask.

The ocular mask may be used in an isolated manner i.e. not being in gaseous communication with the oronasal mask. This provides protection to the eyes but does not provide demisting capabilities.

The respirator air outlet preferably incorporates an air outlet valve and part of the air supplied by the air pressure supply means is used to counter any tendency for air to leak from said outlet valve and into said cavity. This may be used to purge the seat of the valve with clean air; this limits the build-up of dirt on the seat. The air outlet valve may be a pressure valve. Such a valve limits the positive pressure (relative to the ambient external atmosphere) that builds up in the respirator to, for example, 40 mm water.

The air supplied by the air pressure supply means may be caused to ensure that air within said air cavity is purged continuously.

The respirator may further comprise at least one pressure transducer for sensing the pressure within the cavity. This allows measurement of the pressure within the cavity. Such a measurement may allow the quality of the fit of the respirator to be determined. The at least one pressure transducer may be in communication with a control means, the control means being further in communication with the air pressure supply means such that, in use, a substantially constant pressure may be maintained within the cavity.

BRIEF DESCRIPTION OF THE DRAWINGS

The invention will now be described by way of example only, with reference to the accompanying figures, of which.

DETAILED DESCRIPTION

Figure 1:
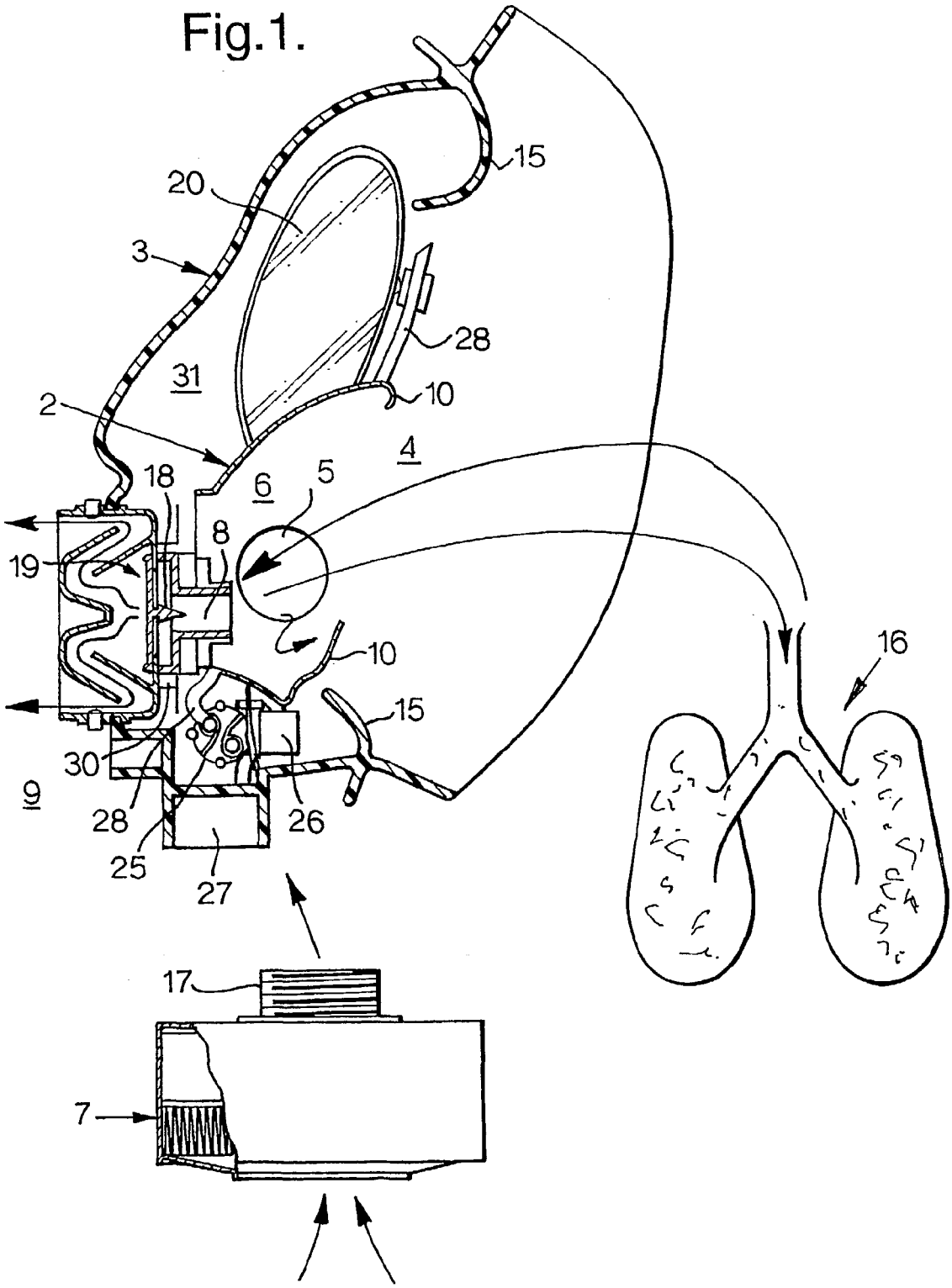
FIG. 1 is a cross-section of a respirator in accordance with the present invention.

FIG. 1 is a cross-section of a respirator in accordance with the present invention. The respirator 1 comprises an inner, oronasal, mask 2 enclosed within an outer, face-sealing mask 3 so as to define a cavity 4 therewith, a screw-threaded respirator air inlet 5 for conducting inhaling air to the interior 6 of the inner mask 2, a filter canister 7 for filtering the inhaling air, and a respirator air outlet 8 for conducting exhaled air from the interior 6 of the inner mask 2. Air is inhaled and exhaled solely through the inner mask 2 and so substantially no air pressure differential exists between the ambient atmosphere 9 and the cavity 4 which will allow ambient air to enter the cavity. Those skilled in the art will realise that the air inlet does not have to be screw threaded; it is merely of this form to facilitate engagement with the screw thread of the particular filter canister 7 that is in common use.

The inner and outer masks 2, 3 are of flexible material, such as rubber. The inner mask 2 is formed with an internal flexible face seal 10. The outer mask 3 is formed with a face-seal 15.

The respirator user's lungs are indicated by reference numeral 16. The filter canister 7 is provided with a screw-threaded outlet 17, which engages with the air inlet 5. The air outlet 8 discharges exhaled air to the ambient atmosphere 9 by way of a non-return valve 18 and a dead space volume 19. The respirator 1 is provided with a pair of eye-pieces 20 (only one of which is shown). However, the respirator 1 may have only a single eye-piece, if desirable.

The respirator 1 is also provided with a small air pump 25, which is driven by an electric motor 26 powered by battery cells (not shown) located in housing 27. The pump 25 draws air through the filter canister 7 and discharges this clean air, by way of a flexible duct 28, towards the eye-pieces 20 so as to demist the same.

In use, air is inhaled and exhaled solely within the inner oronasal, mask 2, which is isolated from the outer, face sealing mask 3 by the flexible seal 10. This arrangement ensures that substantially no negative pressure differential is created in the cavity 4 during inhalation, or across the outer face seal 15. Should the outer face seal 15 become breached, substantially no pressure differential exists to force contaminated ambient air into the respirator 1. The same air that is used to provide active demist also facilitates increased levels of protection by ensuring that a positive pressure always exists in cavity 4, between the inner and outer masks 2, 3. In doing so, any breach of the external seal 15 will result in an egress of clean air from the cavity 4, further reducing the likelihood of contaminated air entering the respirator.

A relief valve 30 is provided so as to prevent over-pressurisation of the eye-space 31, and is arranged to vent to ambient atmosphere 9 by way of the periphery of the outlet 8. This clean air supply may be used to counter any leakage that may occur via outlet valve 18 through delivering the air to the external perimeter of the valve. Air entering the oronasal mask 2 due to outlet valve leakage will be clean air ejected from the cavity 4 as opposed to potentially contaminated air present within the dead space 19. As an alternative to the relief valve arrangement, a portion of air supplied by pump 25 can be used to directly inject clean air into the outlet valve perimeter. The connection between the exhaust side of the valve 30 and the outlet 8 is not shown, for reasons of clarity.

The air injected into cavity 4 by pump 25 and exiting through relief valve 30 serves another purpose, in that it continually purges the air within this volume. Therefore, any contamination entering the cavity due to a breach of the outer face seal 15, is not in contact with the skin for a prolonged period of time as it is continually replaced by clean air.

The oronasal mask 2 and outer mask 3 may be mutually discrete and separate components, with the seal 10 of the oronasal mask 2 being discrete and separate from the seal 15 of the outer mask 3. However, it is anticipated that it may be desirable for the oronasal mask 2 and outer mask 3 to share a certain amount of common seal. For example, the portion of the seal 10 of the oronasal mask 2 worn in the chin region may be integrated with the seal 15 of the outer mask 3 in that region. In such an arrangement, inhaled and exhaled air would not, in normal use, enter the cavity 4 between the oronasal mask 2 and outer mask 3.

The respirator 1 of FIG. 1 provides a respirator with good demist capabilities and good protection against ingress of dangerous agents. However, in the event of failure of the pump 25 then the eye pieces 20 may start to mist, thus severely hindering the effectiveness of the wearer. Furthermore, if both the seal 15 of the outer mask 3 and the pump 25 fail, then potentially contaminated air may enter cavity 4.

However, it is possible to provide a respirator in accordance with the present invention with an air guidance means which allows the management of airflow within the mask to be altered in the event of failure of the pump 25 so that demisting and/or maintenance of a positive pressure within the cavity 4 may be maintained.

Figure 2A:
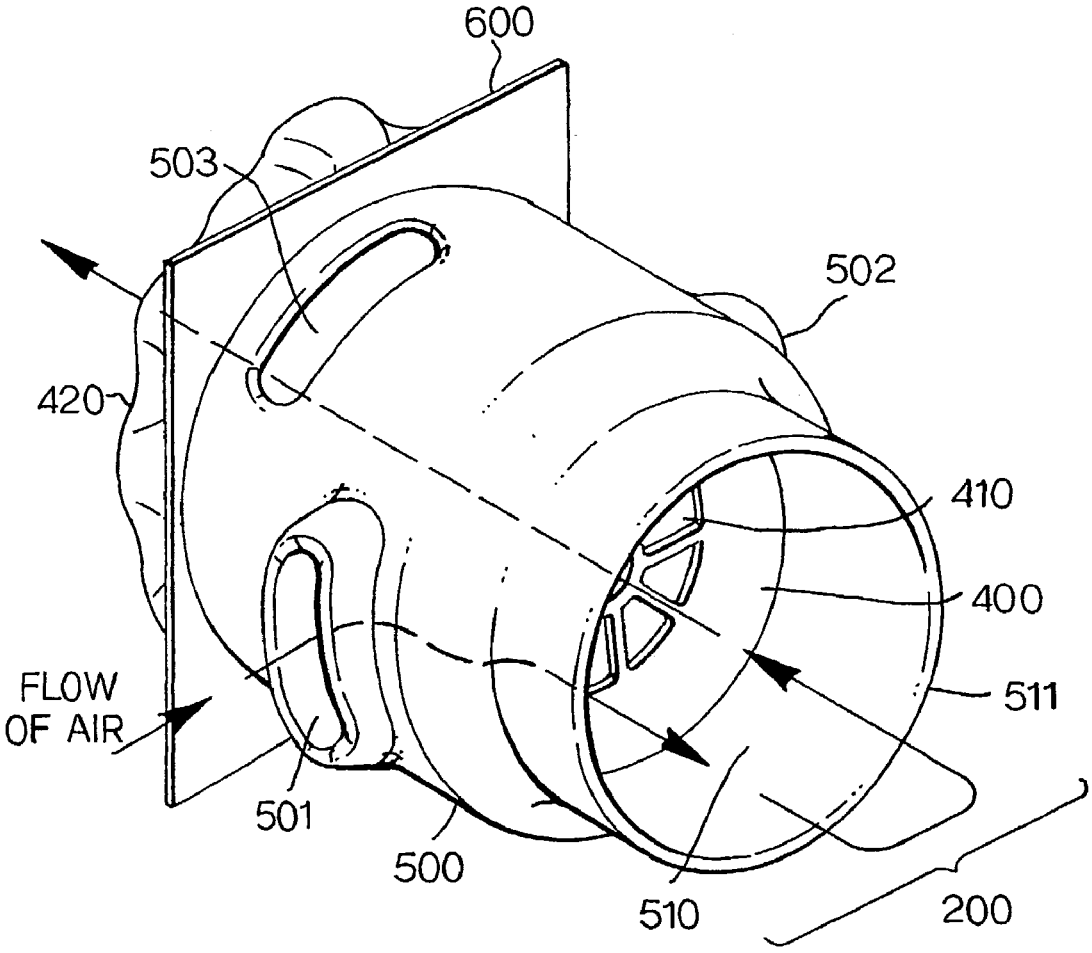
FIG. 2*a* is a cut-away representation of an air guidance means used in a respirator in accordance with the present invention, the respirator being in a normal mode of operation.
Figure 2B:
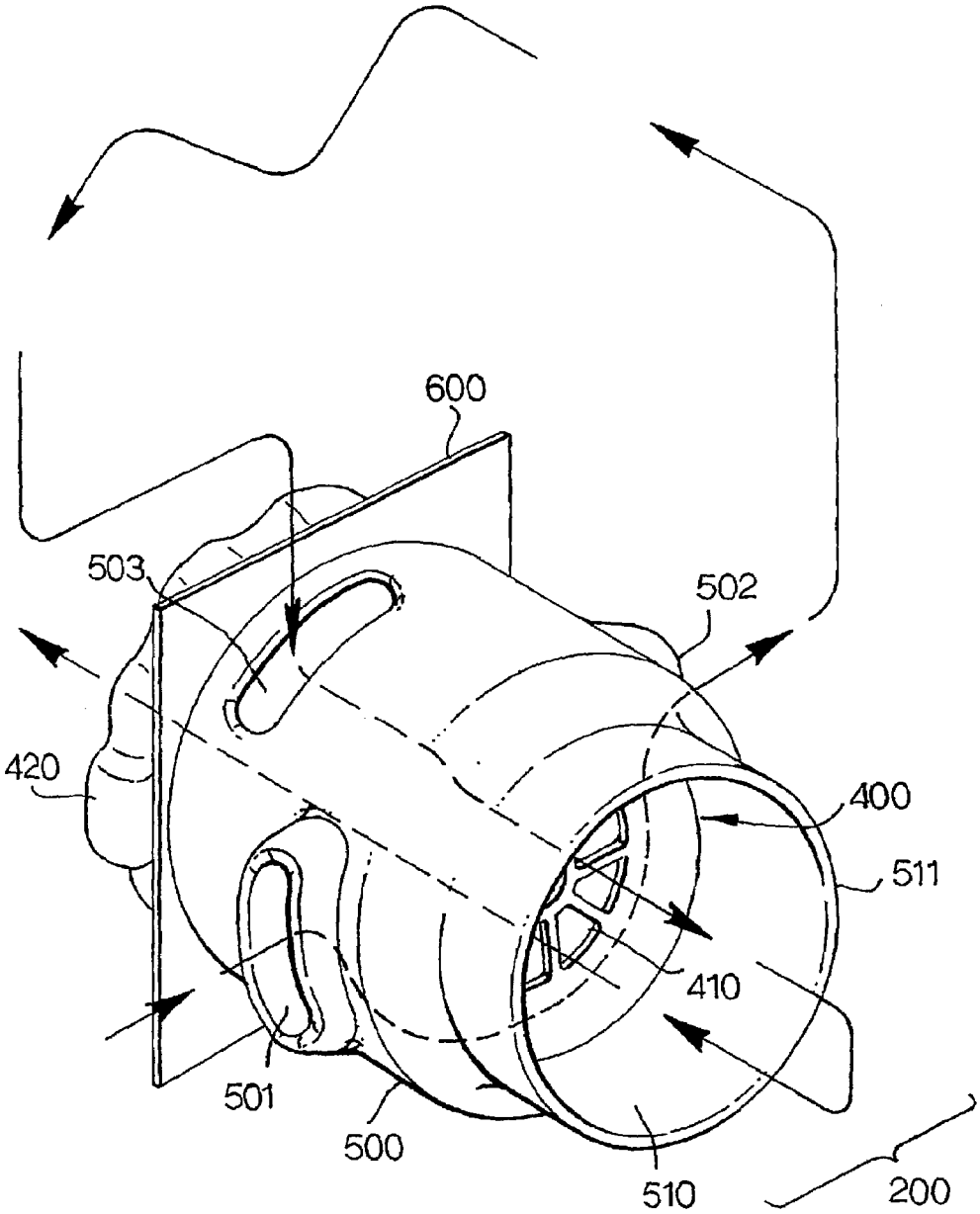
FIG. 2*b* is a cut-away representation of an air guidance means used in a respirator in accordance with the present invention, the respirator being in a failure mode of operation.

FIGS. 2*a* and 2*b* show an air guidance means being used in a respirator is accordance with the present invention. The respirator comprises an inner, oronasal, mask (not shown) enclosed within an outer, face-sealing mask (shown in part by 600) so as to define a cavity (not shown) therewith, a respirator air inlet (not shown) for conducting inhaling air to the interior (not shown) of the inner mask, a filter canister (not shown) for filtering the inhaling air, and a respirator air outlet (not shown) for conducting exhaled air from the interior of the inner mask. During normal operation, air is inhaled and exhaled solely through the inner mask and so substantially no air pressure differential exists between the ambient atmosphere and the cavity which will allow ambient air to enter the cavity. The respirator is further provided with air pressure supply means (not shown), such as a pump, to supply the cavity with air. The outer mask is provided with eye pieces (not shown) and the respirator further comprises air guidance means 200 that is switchable between a first operating position (shown in FIG. 2*a*) in which, in use, part of the air supplied by the air pressure supply means is used to demist the at least one eye piece and a second operating position (shown in FIG. 2*b*) in which, in use, inhaling air is used to demist the at least one eye piece. The air guidance means 200 is usually only switched to the second operating position in a failure mode when the air pressure supply means fails and thus there is no air supplied to the cavity between the inner and outer masks.

Figure 3:
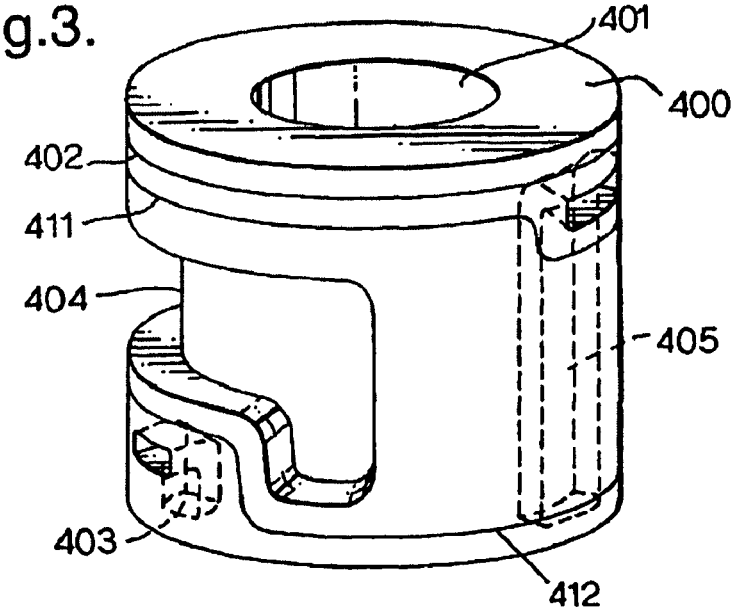
FIG. 3 is a schematic representation of a portion of the inner body used in the air guidance means of FIGS. 2*a* and 2*b.

With reference to FIGS. 2*a*, 2*b* and 3, the air guidance means 200 comprises an inner body 400 rotatably mounted within an outer body 500. The outer body 500 is attached in a gas-tight seal to the outer mask 600. The end 511 of the outer body 500 would abut onto, or protrude into, the oronasal mask, an aperture being provided in the oronasal mask to allow flow of inhaled and exhaled air between the wearer and the ambient atmosphere. The seal between the oronasal mask and the outer body 500 is gas-tight. The outer body 500 has a generally cylindrical shape, internally comprising 2 connected approximately cylindrical cavities viz. a chamber 510 and inner body receipt cavity (not shown). The bore of the chamber 510 is smaller than that of the inner body receipt cavity, hence inner body 400 is in gas-tight seal with the inner body receipt cavity, but cannot enter the smaller chamber 510. The outer body 500 further comprises a first inlet aperture 501 which is in gaseous communication with the filter canister, an outlet aperture 502 which is in gaseous communication with the cavity between the oronasal mask and the outer mask, and a second inlet aperture 503 which is in gaseous communication with the cavity between the oronasal mask and the outer mask. The inner body 400 is of a generally cylindrical shape and comprises a central bore 401 running through the body, a non-return valve 410 situated across one end of the bore 401, an O-ring 402 which, in use, provides a gas tight seal between the inner body 400 and the walls of the inner body receipt cavity, seals 411, 412 and rotation means 420. Rotation means 420 is not shown in FIG. 3 for clarity. When the inner body 400 is inserted into the inner body receipt cavity of the outer body 500, the seals 411, 412 engage with the walls of the outer body 500 to provide gas-tight seals between the three air channels 403, 404 and 405, isolating the air channels 403, 404 and 405 from one another. The inner body 400 and outer body 500 are typically produced from PTFE. The seals 411, 412 may be made from any suitable sealing material, typically silicone rubber. O-ring 402 may be made of rubber. The choice of materials for O-ring 402 and seals 411, 412 depends on the chemical hardness required from these components.

Referring to FIGS. 2*a* and 3, in a normal operating mode, the inner body 400 is oriented within the outer body 500 such that air channel 403 forms a conduit between the first inlet aperture 501 and chamber 510. Thus, filtered air is inhaled into the oronasal mask via air channel 403. Neither of air channels 404, 405 form gaseous connections between the chamber 510 and either of outer body apertures 502, 503. Neither of the air channels 404, 405 form conduits between any of the apertures 501, 502, 503. Hence, channels 404, 405 are effectively blocked and inoperable is this arrangement. Seals 411 and 412 prevent movement of air between air channels 403, 404, 405. Exhaled air passes through non-return valve 410 and out of the respirator. Either of first inlet aperture 501 or air channel 403 may be provided with a non-return valve (not shown) to prevent exhaled air from entering the canister.

If the air pressure supply means fails with the orientation of the air guidance means 200 as described above, then no air enters the cavity between the oronasal and outer masks, and thus misting may occur. The air guidance means 200 may be switched to divert inhaling air to the eye pieces of the respirator to prevent or disperse misting.

Now referring to FIGS. 2*b* and 3, the wearer of the respirator rotates the inner body 400 within the outer body 500 using the rotation means 420 to a second operating position. Such a position is only normally used when the air pressure supply means fails i.e. in failure mode. Air channel 404 forms a conduit between first inlet aperture 501 and outlet aperture 502, thus providing a conduit between the canister and the cavity between the oronasal mask and outer mask. Furthermore, air channel 405 forms a conduit between second inlet aperture 503 and chamber 510, thus forming a conduit between the interior of the oronasal mask and the cavity between the oronasal mask and the outer mask.

Thus, on inhalation by the user, air is drawn through the canister, via the first inlet aperture 501, the air channel 404 and outlet aperture 502 into the cavity between the oronasal and outer masks. Air is then guided, possibly by some form of conduit, over the eye pieces of the respirator. Air is then drawn through the second inlet aperture 503, through the air channel 405, through chamber 510 into the interior of the oronasal mask. Exhaled air would pass to the ambient atmosphere outside of the respirator via the non-return valve 410 and bore 401. In order to prevent egress of exhaled air into the cavity between the oronasal and outer masks, non-return valves (not shown) may be fitted to one of second inlet aperture 503 or air channel 405 and either the outlet aperture 502 or air channel 404. Either of first inlet aperture 501 or an appropriate part of air channel 404 may be provided with a non-return valve (not shown) to prevent exhaled air from entering the canister.

In this failure mode, air channel 403 does not form a gaseous connection between the chamber 510 and any of the apertures 501, 502, 503. The air channel 403 is effectively blocked and inoperable.

Thus, the wearer of the respirator may demist the eye pieces should the air pressure supply means fail.

Other switchable air guidance means will be known to those skilled in the art.

The respirator of FIG. 1 shows how clean, filtered air may be supplied to the eye-piece(s) to facilitate demisting. An alternative respirator that also delivers clean, filtered air to the eye-piece for demisting is shown schematically in FIG. 4. A respirator in accordance with the present invention comprises an inner, oronasal, mask 2 enclosed within an outer, face-sealing mask 3 so as to define a cavity 4 therewith, a respirator air inlet 5 for conducting inhaling air to the interior 6 of the inner mask 2, a filter canister 7 for filtering the inhaling air, and a respirator air outlet 8 for conducting exhaled air from the interior 6 of the inner mask 2. The respirator further comprises an ocular mask 50 comprising at least one eye piece (not shown), the ocular mask 50 being enclosed within the outer, face-sealing mask 3, wherein the ocular mask 50 is provided with an ocular mask air inlet 52 for conducting inhaling air to the interior 51 of the ocular mask and an ocular mask air outlet 53 for conducting inhaling air to the interior 6 of the oronasal mask 2 such that, in use, air is inhaled through the ocular mask 50 before entering the oronasal mask 2. The ocular mask 50 is isolated from the outer, face-sealing mask 3 by a flexible seal, shown generally as reference numeral 60 in FIG. 4.

The function and structure of the components of the respirator are as described with reference to FIG. 1 unless otherwise indicated otherwise with respect to FIG. 4. The arrows of FIG. 4 indicate the direction of air flow.

Air is inhaled through the respirator air inlet 5 into the interior 51 of the ocular mask 50 via the ocular mask air inlet 52, then through the ocular mask air outlet 53 into the interior 6 of the inner mask 2. Air is exhaled via the respirator air outlet 8 to the ambient atmosphere 9 by way of two non-return valves 18, 18*b*. Inhalation and exhalation does not involve movement of air into or out of the cavity 4 between the oronasal mask 2 and the outer mask 3 and so substantially no air pressure differential exists between the ambient atmosphere 9 and the cavity 4 which will allow ambient air to enter the cavity 4.

The respirator is also provided with a small air pump 25, which is driven by an electric motor (not shown), powered by battery cells (not shown). The pump 25 draws air through the filter canister 7 and discharges this clean air, by way of a flexible duct (not shown), into the cavity 4 to maintain a positive air pressure with respect to the ambient atmosphere 9.

Figure 4:
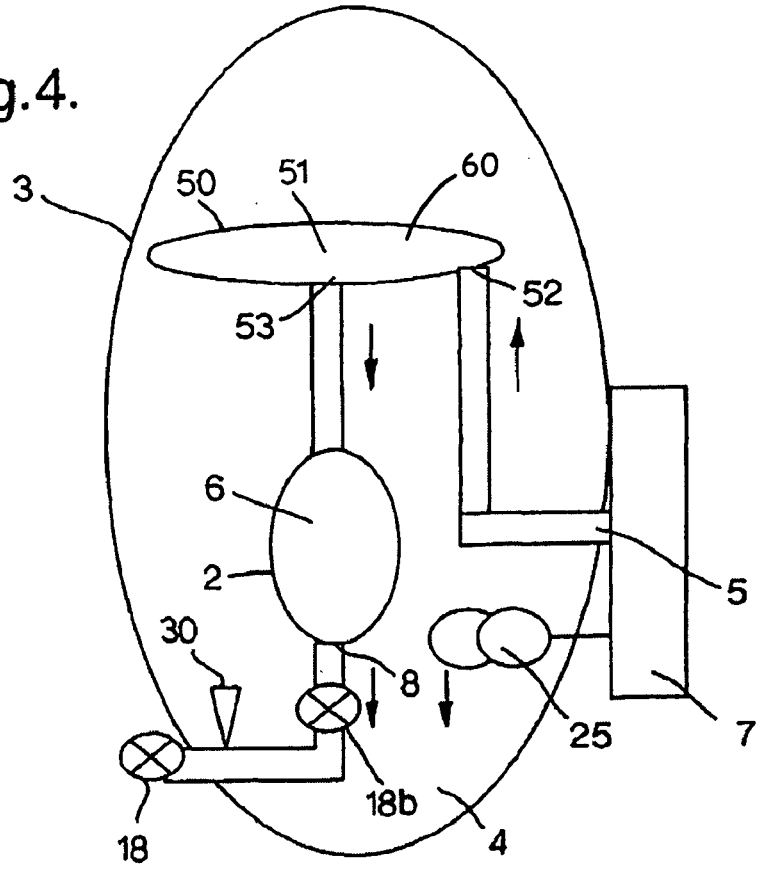
* and FIG. 4 is a schematic of an alternative respirator in accordance with the present invention.

In the respirator of FIG. 4 the air pump 25 is not required to supply air for the demisting of the eye-pieces; inhaled air is used for demisting. In order to maintain a desired positive pressure in the cavity 4, the air pump 25 need only be operated when the pressure in the cavity 4 drops below a certain level. It is of course possible to operate the air pump 25 at all times. If the seal (not shown) on the outer mask 3 fails, then demisting still occurs. Furthermore, if the pump 25 fails, then demisting is still performed without the need to change the management of air within the respirator. The eyes of the wearer are isolated from cavity 4 by ocular mask 50 and hence are protected from any noxious substances that may enter the cavity 4 on failure of the seal of the outer mask.

The relief valve 30 and outlet valve are arranged, and function, essentially as described with respect to FIG. 1, except that there is another outlet valve 18*b* disposed between the outlet valve 18 and the oronasal mask 2. The extra valve 18*b* provides added protection against ingress of potentially dangerous material into the interior 6 of the oronasal mask 2. It will be clear to a person skilled in the art that the relief valve 30 and outlet valve 18 arrangement of FIG. 1 may be used without the additional valve 18*b*.

The ocular mask 50 and the outer mask 3 may be discrete and separate components, with the seal (not shown) of the ocular mask 50 being discrete and separate from the seal (not shown) of the outer mask 3. However, it is anticipated that it may be desirable for these two masks to share a certain amount of common seal. For example, the portion of the seal of the oronasal mask 50 to be worn on the forehead may be integrated with the seal of the outer mask 3 in that region. Indeed, the ocular mask 50 may be totally integrated into the outer mask 3. This would obviate the need for a separate visor region (not shown) in the outer mask 3, the visor region being required if the ocular mask 50 is not integral with the outer mask 3. Such a visor region, possibly comprising additional eyepieces would be required to permit the user to see out of the respirator.

With reference to FIGS. 1 and 4, respirators in accordance with the present invention having air pressure supply means such as the air pump 25 are far superior to those respirators in accordance with the present invention that do not have such a means of pressurising the cavity 4 between the oronasal mask 2 and outer mask 3. In the case of failure of the seal of the outer mask 3, the negative pressure between the cavity 4 and the ambient atmosphere 9 is much lower when the air pressure supply means is used than when the air pressure supply means is not used. The air injected into cavity 4 by pump 25 and exiting through relief valve 30 serves another purpose in that it continually purges the air within this volume. Therefore, any contamination entering the cavity 4 due to a breach of the seal of the outer mask 3 is not in contact with the skin for a prolonged period of time as it is continually replaced by clean air.

The respirators of the present invention may further comprise a speech module. These may be incorporated into the respirator in manners known to those skilled in the art.

Figure 5:
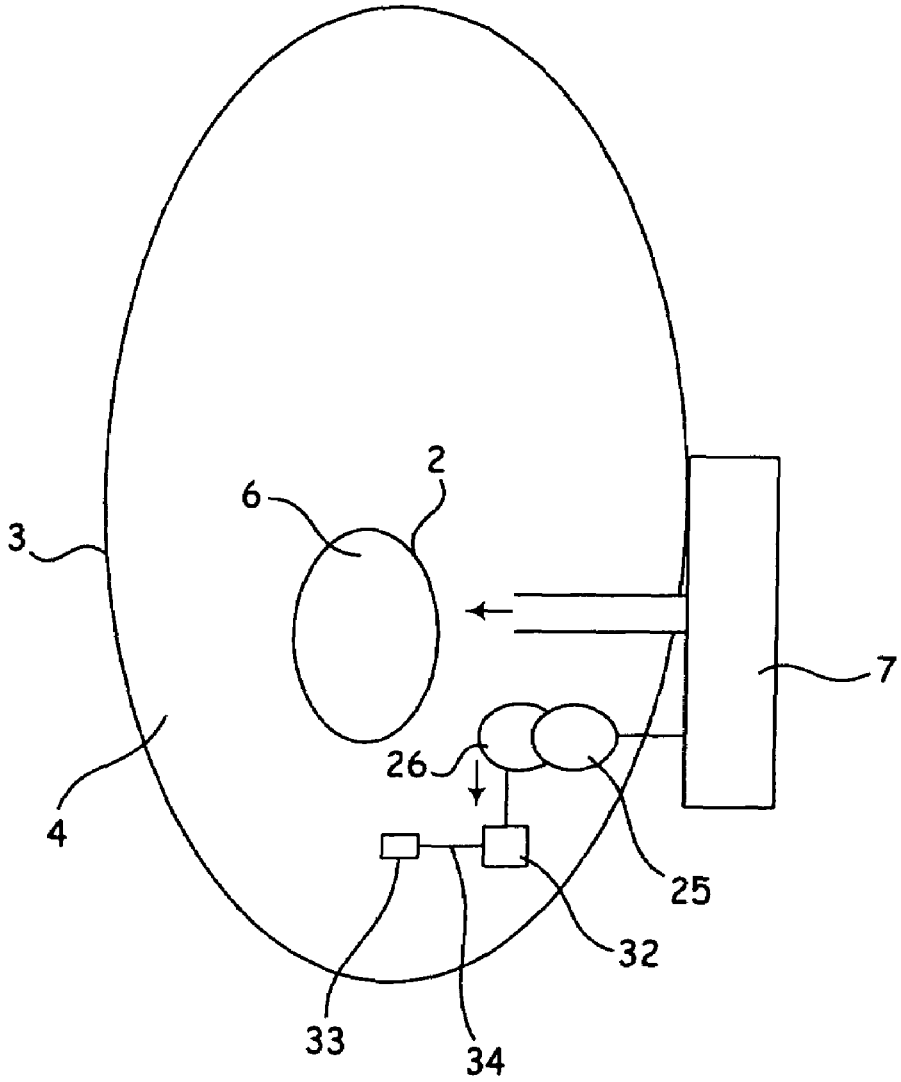
FIG. 5 is a part-schematic of the respirator of FIG. 1 showing feedback control means between a pressure transducer and air pressure supply means.

Referring now to FIG. 5, a pressure transducer 33 is incorporated into the cavity defined by the outer face sealing mask 3 and the inner oronasal mask 2 permitting measurement of pressure within the cavity. The transducer 33 forms part of a feedback loop 34 with a control means 32 controlling the electric motor 26 and pump 25 so as to ensure that a certain constant pressure is maintained in the cavity.

A means (not shown) for the translation of the output of the transducer into coherent, displayed information may form part of the respirator or may be remote from it. The displayed information may allow the wearer to ensure the respirator fits well and even potentially to quantify the quality of the fit.

What is claimed is:

1. A respirator comprising an inner, oronasal mask and an outer, face sealing mask, the outer mask including an eyepiece and the inner and outer masks defining a cavity therebetween, an air inlet means with associated air filter means, an air outlet means operable to deliver exhaled air from the inner mask to the atmosphere and pressurized air supply means operable to deliver pressurized air to the cavity, in which the air inlet means comprise air guidance means operable under negative pressure, in a first position, to deliver air inhaled from the atmosphere directly to the inner mask and, in a second position, to deliver the inhaled air over the eyepiece to the inner mask.

2. A respirator according to claim 1, in which the pressurized air supply means comprise a pump associated with the air inlet means and operable to pressurize inhaled air.

3. A respirator according to claim 1, further comprising means for delivering a part of the pressurized air to the outlet means.

4. A respirator according to claim 1, in which the outlet means comprise an outlet valve additionally comprising a peripheral pressure relief valve.

5. A respirator according to claim 1, further comprising a pressure control means responsive to a pressure transducer and operable to maintain a constant pressure between the cavity and the atmosphere.

6. A respirator according to claim 1, in which the air guidance means comprise generally cylindrical inner and outer bodies, each defining a central bore, in which the inner body is rotatably mounted in part sealing contact within the outer body, the inner body including a first and second channel therein, the outer body including a first and second inlet aperture and an outlet aperture therein, the inner and outer body defining a third channel therebetween, and means for rotating the inner body within the outer body such that in the first position the third channel communicates between the first inlet aperture and the bore of the outer body and in the second position the first channel communicates between the first inlet aperture and the outlet aperture and the second channel communicates between the second inlet aperture and the bore of the outer body.

7. A respirator according to claim 6, in which the air guidance means further comprise a non-return valve disposed across the cavity of the bore of the outer body.

8. A respirator comprising an inner, oronasal mask, an outer, face sealing mask, the inner and outer masks defining a cavity therebetween, an ocular mask including sealing means, an air inlet means with associated air filter means, an air outlet means operable to deliver exhaled air from the inner mask to the atmosphere and pressurized air supply means operable to deliver pressurized air to the cavity, in which the air inlet means comprise air guidance means operable to deliver, under negative pressure, air inhaled from the atmosphere to the inner mask via the ocular mask.

9. A respirator according to claim 8, in which the pressurized air supply means comprise a pump associated with the air inlet means operable to pressurize inhaled air.

10. A respirator according to claim 8, further comprising means for delivering a part of the pressurized air to the outlet means.

11. A respirator according to claim 8, in which the outlet means comprise an outlet valve having a peripheral pressure relief valve.

12. A respirator according to claim 8, further comprising a pressure control means responsive to a pressure transducer operable to maintain a substantially constant pressure between the cavity and the atmosphere.

13. A respirator according to claim 8, in which the ocular mask, at least in part, is integrally formed with the outer mask.

* * * * *